US005221046A

United States Patent [19]

Timmer

[11] Patent Number: 5,221,046

[45] Date of Patent: Jun. 22, 1993

[54] METHANOL FUELED DIESEL INTERNAL COMBUSTION ENGINE FUEL INJECTOR NOZZLE

[75] Inventor: Robert C. Timmer, Grandville, Mich.

[73] Assignee: Diesel Technology Company, Wyoming, Mich.

[21] Appl. No.: 757,825

[22] Filed: Sep. 10, 1991

[51] Int. Cl.[5] ..... F02M 47/00

[52] U.S. Cl. ..... 239/88; 239/533.9; 239/585.1

[58] Field of Search ..... 239/533.2, 533.3, 533.6, 239/533.8-533.12, 585, 88-91, 95

[56] References Cited

U.S. PATENT DOCUMENTS

| | | | |
|---|---|---|---|
| 4,129,253 | 12/1978 | Hader, Jr. et al. | 239/88 |
| 4,392,612 | 7/1983 | Deckard et al. | 239/88 |
| 4,470,548 | 9/1984 | Ushimura | 239/533.3 |
| 4,505,243 | 3/1985 | Miwa | 123/446 |
| 4,570,853 | 2/1986 | Schmied | 239/533.3 |
| 4,897,907 | 2/1990 | Kopiec et al. | 239/533.9 |

OTHER PUBLICATIONS

SAE Technical Paper Series 831744: Development of Detroit Diesel Allison 6V-92TA Methanol Fueled Coach Engine; R. R. Toepel, J. E. Bennethum, and R. E. Heruth, published Oct. 31, 1983.

SAE Technical Paper Series 901564; Development Status of the Detroit Diesel Corporation Methanol Engine; S. P. Miler and C. L. Savonen, published Sep. 10, 1990.

Diagram of Needle Valve Tip Design-Reduced SAC VCO (Feb. 28, 1981).

*Primary Examiner*—Andres Kashnikow
*Assistant Examiner*—Karen B. Merritt
*Attorney, Agent, or Firm*—Brooks & Kushman

[57] ABSTRACT

A spray injector nozzle for a diesel engine fuel injector particularly suited for methanol and other low cetane liquid fuels constructed in a manner to effectively disburse fuel to the combustion chamber and maintain to a minimum hydrocarbon emissions, and substantially control or eliminate the build up of harmful deposits at the injector orifice. The spray injector nozzle is provided with an inner main cavity and an inner second cavity portion capable of flow communication with a pressurized fuel supply and a plurality of spray outlets to communicate the fuel to the combustion chamber. A retractable needle is utilized to engage an inner valve seat and completely block the flow of fuel communication to the spray outlets with the spray outlets located high in the valve seat of the spray nozzle. In one form, the nozzle includes a ball or other insert member completely filling the sac portion of a valve covered orifice type injection tip.

6 Claims, 1 Drawing Sheet

METHANOL FUELED DIESEL INTERNAL COMBUSTION ENGINE FUEL INJECTOR NOZZLE

TECHNICAL FIELD

This invention relates to fuel injectors of the type used to inject fuel into the cylinders of a diesel engine and more particularly to a fuel injector nozzle design capable of maintaining to a minimum hydrocarbon emissions.

BACKGROUND ART

Fuel injectors are commonly used to pressure inject liquid fuel into the combustion cylinders of diesel engines. As is well known, fuel injectors include a pump in the form of a plunger and bushing or cylinder which is actuated, for example, by an engine driven cam. The pump is utilized to pressurize fuel to a suitable high pressure so as to effect the unseating of a pressure actuated injection valve in the fuel injection nozzle incorporated into the injector.

In one form of a common fuel injector, a solenoid valve is incorporated into the injector so as to control the drainage of fuel from the pump chamber of the unit injector. In this latter type of injector, fuel injection is controlled by the energization of the solenoid valve, as desired, during a pump stroke of the plunger, thereby terminating drain flow and permitting the plunger to increase the fuel pressure to effect unseating of the injection valve of the associated fuel injection nozzle. An example of such an electromagnetic fuel injector is disclosed in U.S. Pat. No. 4,129,253 entitled "Electromagnetic Fuel Injector" issued Dec. 12, 1978 to Ernest Bader, Jr., John I. Deckard and Dan B. Kuiper, and assigned to the assignee of the present invention.

Another example of the electromagnetic fuel injector is disclosed in U.S. Pat. No. 4,392,612 entitled "Electromagnetic Fuel Injector" issued Jul. 12, 1983 to John I. Deckard and Robert D. Straub, also assigned to the assignee of the present invention. These prior art fuel injectors include what is known in the industry as a sac-type injector tip or nozzle, meaning that there is a free space or cavity between the end of the injection valve and the bottom of the injector tip. In the patents mentioned, the spray orifices are located in the sac and thus below the valve seat. It is also common to locate the spray orifice radially apart the valve seat; thus being referred to as a valve covered orifice (VCO) type injector tip. Other injection fuel tip designs exist but are not in use to the extent of those mentioned.

In all cases, the objective is to acquire an effective fuel spray to the combustion chamber, e.g., a complete and quick dispersion of fuel to all areas of the combustion chamber for efficient combustion. Likewise, an objective is to provide a nozzle tip design which is minimally effected by a production of combustion product deposits, i.e., hydrocarbon deposits, which effect the metering or passage of fuel through the spray orifices.

SUMMARY OF THE INVENTION—FOR INJECTOR NOZZLE TIP DESIGN

This invention contemplates a fuel injector capable of maintaining to a minimum hydrocarbon emissions.

The invention further contemplates a fuel injector for a diesel cycle internal combustion engine particularly suited for methanol and other low cetane liquid fuels such as ethanol, having an injector tip constructed in a manner to effectively disburse fuel to the combustion chamber and substantially control or eliminate the build up of harmful deposits at the injection orifice.

The invention further contemplates a fuel injector for a diesel cycle internal combustion engine having an injector tip design substantially eliminating the interior injector cavity volume trapped between the internal surfaces of the injector below the spray hole and the tip of the injector needle, commonly known as the "sac" volume.

The invention further contemplates a fuel injector for an internal combustion engine wherein the sac volume, as above identified, is filled with an annular object, such as a steel ball, capable of effecting the fuel flow within the injector cavity.

The above objects and other objects, features and advantages of the present invention are readily apparent from the following detailed description of the best mode for carrying out the invention when taken in connection with the accompanying drawings.

BRIEF DESCRIPTION OF THE ART

Figure 1:
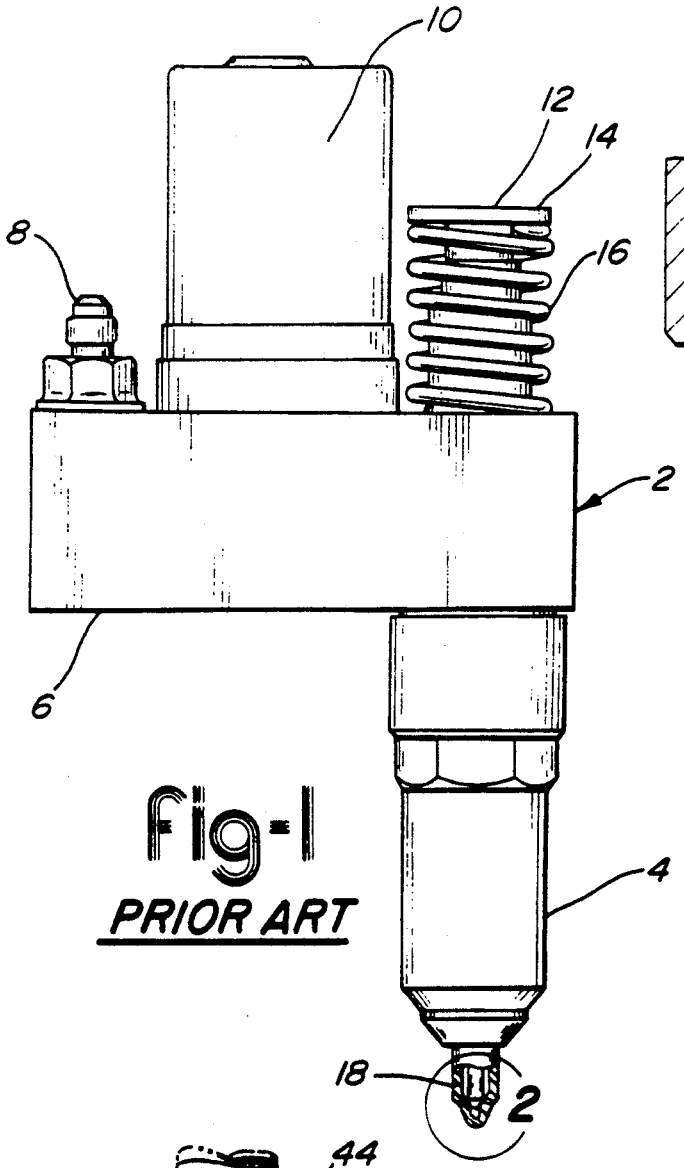
Fig-1 PRIOR ART
FIG. 1 is a longitudinal, partially sectional view of an electromagnetic unit fuel injector in accordance with the prior art.

Referring now to FIG. 1, there is generally shown an electromagnetic fuel injector with the pump assembly utilizing an electromagnetic actuated, pressure valve incorporated to control fuel discharged from the injector portion of the assembly to a combustion chamber. A full description of all components of the injector is given in U.S. Pat. No. 4,392,612 which is incorporated herein by reference and forms no part of the present invention.

The electromagnetic fuel injector includes an injector body 2 which includes a vertical main body 4 and a side body portion 6. The side body portion 6 also includes a fuel inlet 8, a solenoid actuated valve assembly 10, and a spring biased plunger assembly 12. The spring biased plunger assembly includes a follower 14, a spring 16 and a pump plunger not shown.

Fuel, as from a fuel tank via a supply pump and conduit (not shown), is supplied at a relatively low pressure to the fuel inlet 8. Fuel is then metered by operation of the solenoid actuated valve assembly 10 and passed to the spring biased plunger assembly 12 via a flow passage (not shown). Fuel entering the spring biased plunger assembly 10 is pressurized to a relatively high pressure, by operation of the pump plunger. This pressurized fuel is then communicated to a spray nozzle 18 located at the lower portion of the vertical main body portion 4.

Figure 2:
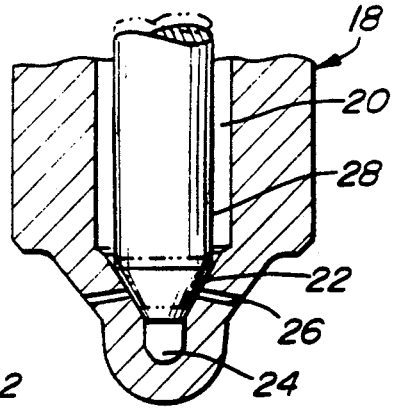
Fig-2 PRIOR ART
FIG. 2 is an enlarged sectional view of the segment of the injector shown within the encircled portion 2 of FIG. 1, but illustrating a second conventional injector tip design.

As shown in FIG. 2, a spray nozzle design of the prior art includes an inner main cavity 20, an inner valve seat 22 located between the main cavity and the inner second cavity portion 24, all capable of flow communication with the pressurized fuel supply. The inner valve seat 22 is located below the inner main cavity 20 and has a plurality of spray outlets 26. Fuel communicated to this spray nozzle described at a relatively high pressure unseats the retractable needle means 28 and delivers fuel to the combustion chamber of a diesel engine (not shown).

Figure 3:
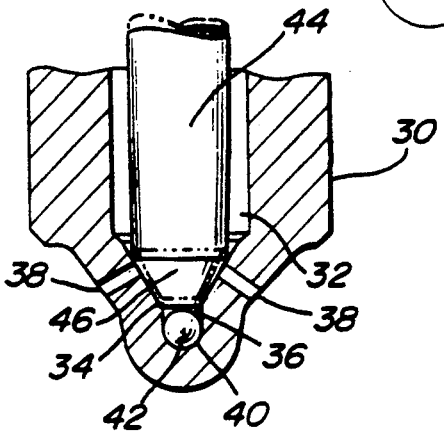
FIG. 3 is a view similar to FIG. 2 and showing a modified injector tip design in accordance with the present invention.

As shown in FIG. 3, a preferred embodiment of the invention utilizes a spray nozzle 30 having an inner main cavity 32 and inner valve seat 34 located between the main cavity 32 and the inner second cavity portion 36 all capable of flow communication with a pressurized fuel supply (not shown). The inner valve seat 34 is located below the inner main cavity 32 and has a plurality of spray outlets 38 extending outwardly substantially horizontally and radially to the surface of the spray nozzle 30 spaced equidistant from each other. The inner second cavity portion 36 is located below the inner valve seat 34 and is closed at its opposite end to provide a closed spherical chamber 40. The inner second cavity portion 36 of the spray nozzle 30 has an insert 42 slip fit inside the spherical chamber 40.

A retractable needle means 44 is thus shaped to correspondingly fit and fully engage the inner valve seat 34 and completely block the flow of communication to the spray outlets 38. The retractable needle means 44 leaves substantially no volume interspaced between the inner valve seat 34 and the lower nose portion 46 of the needle means but significantly, does not engage any portion of the inner second cavity 36 or the slip fit insert 42.

The slip fit insert 42 nearly substantially fills the inner second cavity 36, but does require some minimal amount of clearance between the insert 42 and inner second cavity 36. A steel ball as the insert, (as shown) in the second cavity works particularly well. This particular embodiment exhibited a lower HC emission characteristic representing a 30–40% decrease in hot cycle hydrocarbon emissions over the standard valve covered orifice tips and standard eight holed low sac tips.

Other alternative embodiments in this family utilize inserts of different shapes. All the inserts of this type should be made of material compatible with low cetane liquid fuels containing methanol.

Figure 4:
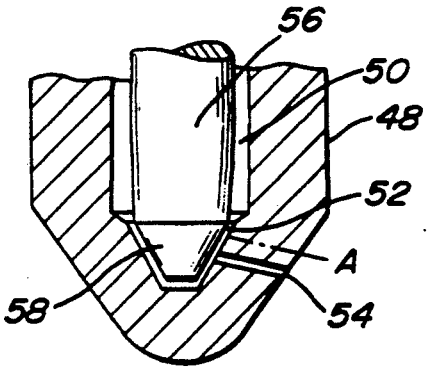
FIG. 4 is a view similar to FIG. 3 showing an alternative embodiment of the injector tip design in accordance with the present invention.

As shown in FIG. 4, another embodiment of the invention herein disclosed utilizes an elongate nozzle 48 having an inner cavity 50 adapted to convey to a combustion chamber a pressurized fuel supply, and an inner valve seat 52 located at the base of the inner cavity 50. The nozzle itself has a plurality of spray outlets 54 located at the valve seat 52 extending radially outward from the valve seat and through the nozzle 48. The spray outlets 54 are substantially equally radially spaced from each other.

To achieve adequate hydrocarbon emission reduction, the present invention requires locating the spray outlets 54 high up in the valve seat 52 as shown in FIG. 4. An alternative embodiment of this design of spray nozzle locates spray outlets 54 at different heights along the higher portion of the valve seat 52. This family of alternative embodiments as shown by centerline A produces lower hydrocarbon emissions as a function of spray outlet location relative to the valve seat. The higher up the spray outlets 54 are positioned relative to the inner valve seat 52, the larger hydrocarbon emission reduction potential.

A retractable needle means 56 is utilized to close flow communication with the spray outlets 54 and is correspondingly shaped to the inner valve seat 52 to fully engage the valve seat 52 and completely block fuel flow communication. The corresponding fit between the inner valve seat 52 and the lower nose portion 58 of the retractable needle 56 yields substantially no volume interspaced between the inner valve seat 52 and the lower nose portion 58.

While the best modes for carrying out the invention have been described in detail, those familiar with the art to which this invention relates will recognize alternative designs and embodiments for practicing the invention. Thus, the above described preferred embodiment is intended to be illustrative of the invention which may be modified within the scope of the following appended claims.

What is claimed is:

1. A fuel injector comprising, a nozzle having an inner main cavity, an inner valve seat located between said main cavity and an inner second cavity portion all capable of flow communication with a pressurized fuel supply, said inner valve seat located below said inner main cavity and having a plurality of spray outlets extending outward substantially horizontally and radially to the surface of said nozzle spaced equidistant from each other, said inner second cavity portion located below said inner valve seat and being closed at its opposite end to provide a closed spherical chamber, said inner second cavity portion of said nozzle also having an insert loosely located with and substantially filling said spherical chamber, a retractable needle means having a nose portion and a shaft portion, said nose portion being correspondingly shaped to fully engage said inner valve seat completely blocking flow communication to said spray outlet and leaving substantially no volume interspaced between said inner valve seat and said nose potion of said needle means, and said nose portion being free of engagement with any portion of said inner second cavity portion and said insert.

2. A fuel injector as in claim 1 wherein said insert is spherical in shape.

3. A fuel injector as in claim 1 wherein said insert is of a material compatible with low cetane liquid fuels containing methanol.

4. A fuel injector as in claim 1 wherein said insert is manufactured of stainless steel and is spherical in shape.

5. A fuel injector as in claim 1 wherein said spray outlets are located at the highest engagement position of said nose portion of said needle means and said inner valve seat with respect to the bottom of said nozzle.

6. A fuel injector as in claim 1 wherein said spray outlets are located anywhere within the length of the engagement surface of said nose portion of said needle means and said inner valve seat extending from the midpoint of the length of the engagement surface to a point on the engagement surface which is furthest removed from said inner second cavity portion.

* * * * *